US007213706B2

(12) United States Patent
Belser et al.

(10) Patent No.: US 7,213,706 B2
(45) Date of Patent: May 8, 2007

(54) PACKAGING SYSTEM FOR A DISPOSABLE CLEANING HEAD

(75) Inventors: Deborah A. Belser, Pleasanton, CA (US); Thomas Cantwell, Kalamazoo, MI (US); John Hoffman, Kalamazoo, MI (US); Christopher Pressley, Kalamazoo, MI (US)

(73) Assignee: The Clorox Co., Oakland, CA (US)

( * ) Notice: Subject to any disclaimer, the term of this patent is extended or adjusted under 35 U.S.C. 154(b) by 610 days.

(21) Appl. No.: 10/663,148

(22) Filed: Sep. 12, 2003

(65) Prior Publication Data

US 2005/0056558 A1 Mar. 17, 2005

(51) Int. Cl.
*B65D 85/10* (2006.01)

(52) U.S. Cl. ..... 206/362; 220/524

(58) Field of Classification Search ..... 206/361, 206/362, 581, 232, 209, 209.1, 362.1, 362.2, 206/363; 15/145, 184, 185, 176.1, 146, 147.1; 220/524; D9/425, 423

See application file for complete search history.

(56) References Cited

U.S. PATENT DOCUMENTS

| | | | | |
|---|---|---|---|---|
| 5,488,748 | A * | 2/1996 | Koch | 15/104.94 |
| 5,941,379 | A * | 8/1999 | Barardo | 206/209 |
| 2002/0144370 | A1 * | 10/2002 | Varga | 15/145 |

* cited by examiner

*Primary Examiner*—Shian T. Luong
(74) *Attorney, Agent, or Firm*—Monica Winghart; Rich Niehuser

(57) ABSTRACT

A packaging system comprising a plurality of disposable cleaning heads, each of the plurality of cleaning heads including at least one cleaning substrate and a one-piece flexible fitment, the fitment including an engagement member adapted to removably engage a handle, and a shell having a bottom and a top, the top being hingedly connected to the bottom whereby said shell has an open position and a closed position, the bottom including a first cavity adapted to receive and retain at least one of the plurality of cleaning heads, the top including a second cavity adapted to receive and retain at least one of said plurality of cleaning heads. Preferably, the first and second cavities are adapted to receive and retain at least three of the plurality of cleaning heads.

14 Claims, 5 Drawing Sheets

PACKAGING SYSTEM FOR A DISPOSABLE CLEANING HEAD

FIELD OF THE PRESENT INVENTION

The present invention relates generally to cleaning pads and related systems for cleaning surfaces. More particularly, the invention relates to a packaging system for a disposable cleaning head having a cleaning composition suitable for cleaning toilet bowls and the like.

BACKGROUND OF THE INVENTION

Cleaning a toilet bowl is typically one of the most undesirable jobs for most persons. Nevertheless, toilet bowls must be kept clean in order to prevent sanitary problems, the potential for irritable smells, and the possibility of harmful bacteria buildup.

As a result, various types of bowl cleaning products are known. Such products typically fall within two categories, namely, cleaning by hand with a bowl cleaner or with automatic "in tank" or "in bowl" cleaners. Hand cleaning typically takes the form of a toilet cleaning brush or sponge. Such devices, however, are displeasing due to the excessive dripping therefrom and because storage between uses is unsanitary. Further, there is no premeasured dosage with current bowl cleaning products. Most users just estimate the amount to use and potentially could use too little and thus not achieve a disinfectant level, or too much, which increases the cost per application. Additionally, bowl cleaning products are very toxic and present a potential safety hazard.

Automatic "in tank" or "in bowl" cleaners, which dispense a dosage upon flushing of the toilet, generally are not as effective as manual scrubbing. Therefore, most consumers typically supplement such automatic cleaners with hand scrubbing and cleaning. In addition to often ineffective cleaning, "in tank" or "in bowl" cleaners have other disadvantages. For example, "clear water" types of cleaners give no indication when they are used up and need changing, and having to place one's arm into a toilet bowl and/or tank to retrieve spent containers is also unpleasant and undesirable. Further, the "blue water" products are, in many instances, only cosmetic and, at best, merely add a small amount of surfactant to the water.

Numerous types of cleaning compositions, as well as holders for disposable cleaning pads, are known in the art. Illustrative are the compositions and apparatus disclosed in U.S. Pat. Nos. 4,852,201, 4,523,347, 4,031,673, 3,413,673 and 3,383,158. A major drawback of the noted toilet bowl cleaners, including the "blue water" products, is that a user must "directly" handle the cleaner to place the cleaner in the toilet bowl and, in most instances, to remove and/or replace same.

It is therefore an object of the present invention to provide a packaging system for a disposable cleaning head that overcomes the disadvantages and shortcomings associated with prior art cleaning heads, pads and packaging systems therefore.

It is another object of the invention to provide a packaging system for a disposable cleaning head having a pre-determined amount of cleaning composition that effectively cleans and disinfects a toilet surface.

It is another object of the invention to provide a packaging system for a disposable cleaning head that is readily engagable to and releasable from a variety of handles.

It is another object of the invention to provide a packaging system for a disposable cleaning head that eliminates the necessity of direct user contact to remove and replace the cleaning head.

It is yet another object of the invention to provide a packaging system for a disposable cleaning head that enhances the shelf life and stability of the cleaning head.

SUMMARY OF THE INVENTION

In accordance with the above objects and those that will be mentioned and will become apparent below, the packaging system in accordance with this invention comprises a plurality of disposable cleaning heads, each of the plurality of cleaning heads including at least one cleaning substrate and a flexible fitment, the fitment including an engagement member adapted to removably engage a handle, and a shell having a bottom and a top, the top being hingedly connected to the bottom whereby said shell has an open position and a closed position, the bottom including a first cavity adapted to receive at least one of the plurality of cleaning heads, the top including a second cavity adapted to receive at least one of said plurality of cleaning heads. Preferably, the first and second cavities are adapted to receive and retain at least three of the plurality of cleaning heads.

BRIEF DESCRIPTION OF THE DRAWINGS

Further features and advantages will become apparent from the following and more particular description of the preferred embodiments of the invention, as illustrated in the accompanying drawings, and in which like referenced characters generally refer to the same parts or elements throughout the views, and in which.

DETAILED DESCRIPTION OF THE PREFERRED EMBODIMENT

Figure 1:
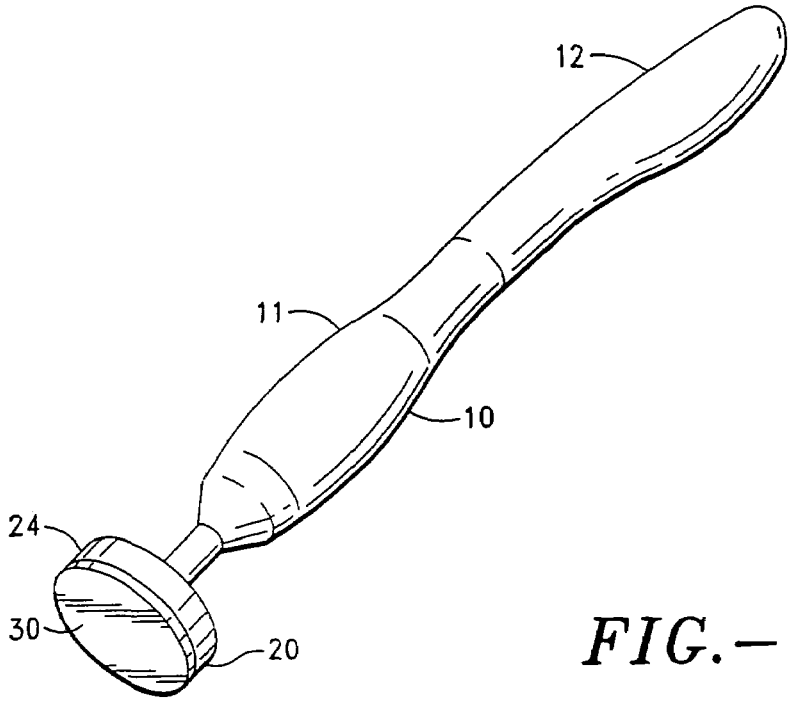
FIG. 1 is a perspective view of a disposable cleaning head operatively attached to a handle, according to the invention.

Before describing the present invention in detail, it is to be understood that this invention is not limited to particularly exemplified structures, compositions, systems or uses, as such may, of course, vary. It is thus to be understood that the terminology used herein is for the purpose of describing particular embodiments of the invention only, and is not intended to be limiting.

All publications, patents and patent applications cited herein, whether supra or infra, are hereby incorporated by reference in their entirety.

It must be noted that, as used in this specification and the appended claims, the singular forms "a," "an" and "the" include plural referents unless the content clearly dictates otherwise. Thus, for example, reference to "a receptacle" includes two or more such receptacles and the like.

DEFINITIONS

Unless defined otherwise, all technical and scientific terms used herein have the same meaning as commonly understood by one of ordinary skill in the art to which the invention pertains. Although a number of materials and methods similar or equivalent to those described herein can be used in the practice of the present invention, the preferred materials and methods are described herein.

In describing the present invention, the following terms will be employed and are intended to be defined as indicated below.

The term "sponge", as used herein, is meant to mean an elastic, porous material, including, but not limited to, a compressed sponge, a cellulosic sponge, reconstituted cellulosic sponge, cellulosic material, foam from a high internal phase emulsion, such as those disclosed in U.S. Pat. No. 6,525,106, polyethylene, polypropylene, polyvinyl alcohol, polyurethane, polyether, and polyester sponges, foams and nonwoven materials.

The term "cleaning composition", as used herein, is meant to mean and include a cleaning formulation having at least one surfactant.

The term "surfactant", as used herein, is meant to mean and include a substance or compound that reduces surface tension when dissolved in water or water solutions, or that reduces interfacial tension between two liquids, or between a liquid and a solid. The term "surfactant" thus includes anionic, nonionic and/or amphoteric agents. Examples of suitable surfactants include, but are not limited to, sodium lauryl sulfate, sodium xylene sulfonate, coco amine oxide, nonoxynol-9, linear alkyl naphthalene sulfonate, ethoxylated alcohol, alkyl ether sulfates, alcohol ethoxysulfates, alkyl benzene sulfonate, alpha olefin sulfonate, linear alcohol ether sulfates, linear primary alcohol ethoxylate, alkyl sulfates, alkyl aryl sulfonates, amine oxides, taurates, sarcosinates, isethionates, linear alkylbenzene sulfonates, and mixtures thereof.

The term "interference fit", as used herein, is meant to mean the engagement of a component having a dimension "x" by a second component or section thereof having a dimension "y", where "y" is less than "x". For example, the engagement of a disk having a diameter of 3.0 in. into a receptacle having a diameter of 2.85 in. would be deemed an interference fit. The interference would thus be 0.15 in.

As will be appreciated by one having ordinary skill in the art, the packaging system of the invention substantially reduces or eliminates the disadvantages and drawbacks associated with prior art cleaning heads and systems. In one embodiment of the invention, the packaging system generally comprises a shell having a top and a bottom hingedly connected thereto, the top and bottom each having a cavity formed therein that is adapted to receive and secure at least one, preferably, a plurality of disposable cleaning heads therein.

The disposable cleaning head, which is described in detail in U.S. Pat. No. 7,127,768, generally includes at least one cleaning substrate that includes a cleaning composition and a substantially flexible fitment (or cap) that facilitates bending and rotation of the cleaning head relative to the handle without the necessity of a mechanical joint. The noted application is expressly incorporated in its entirety by reference herein.

Referring first to FIG. 1, there is shown a cleaning head 20 operatively connected to a handle or tool assembly 10 (shown in phantom). Preferably, the tool assembly 10 includes an elongated shaft 11 having a handle portion 12 on one end thereof. The tool assembly 10 further includes a gripping mechanism that is mounted to the shaft 11 and includes a contact region moveable between a gripping condition and a release condition.

In the gripping condition, the contact region of the gripping mechanism cooperates with the engagement member 38 of the cleaning head 20 (see FIG. 2) to releasably mount the cleaning head 20 to the elongated shaft 11. In the release condition, the cleaning head 20 is released from the gripping mechanism and thereafter disposed. Further details of the tool assembly 10 are set forth in Co-pending Published Patent Application No. 20050066465, entitled "Cleaning Tool Assembly with a Disposable Cleaning Implement," filed Sep. 30, 2003.

Figure 2:
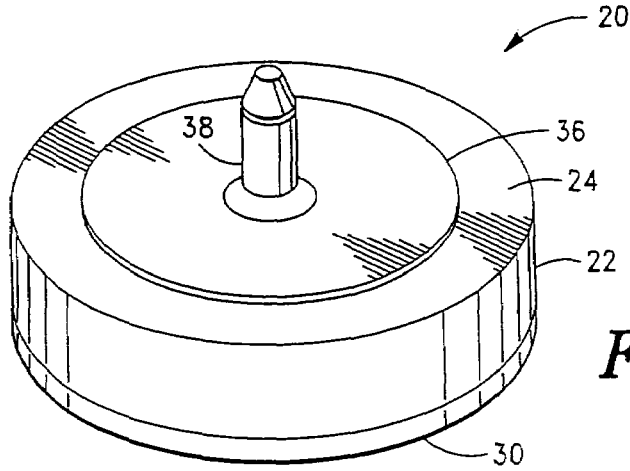
FIG. 2 is a further perspective view of the disposable cleaning head, according to the invention.
Figure 3:
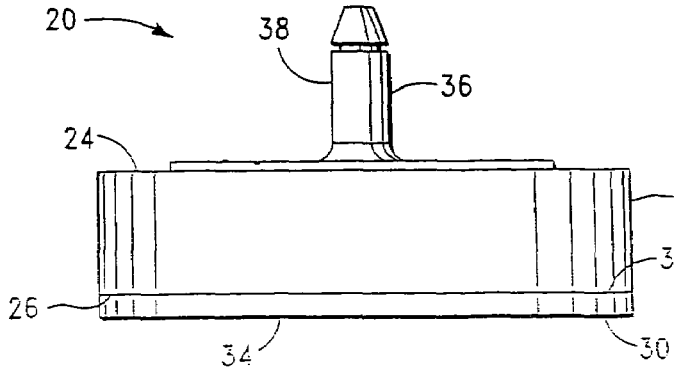
FIG. 3 is a front plane view of the disposable cleaning head shown in FIG. 2.

As indicated, the disposable cleaning head 20 generally includes at least one cleaning substrate 21 and a fitment 36. As set forth in the noted Co-Pending Application Ser. No. 10/663,496, the cleaning substrate 21 can comprise either a sponge or a scrim, or, as illustrated in FIGS. 2 and 3, a combination of a sponge 22 and a scrim 30.

In the illustrated embodiment, the sponge 22 is substantially disk shaped and preferably has substantially planar top 24 and bottom 26 surfaces. The sponge 22 can comprise various materials, such as a cellulosic material, a foam produced from a high internal phase emulsion, such as those disclosed in U.S. Pat. No. 6,525,106, polyethylene, polypropylene, polyvinyl alcohol, polyurethane, polyether, and a polyester sponge, foam and nonwoven material, and like materials.

Preferably, the sponge 22 (and, hence, cleaning head 20) has a maximum planar dimension or, in this instance, a diameter in the range of approximately 1.0–6.0 in., more preferably, in the range of approximately 2.75–3.25 in. and a thickness in the range of approximately 0.5–31.0 in., more preferably, in the range of approximately 0.70–0.80 in.

The sponge 22 also has an open pore structure, having an average pore size preferably in the range of approximately 3–110 pores/linear inch, more preferably, in the range of approximately 40–80 pores/linear inch.

As illustrated in FIG. 3, the scrim 30 similarly, preferably includes substantially planar top 32 and bottom 34 surfaces and is preferably secured to one surface (e.g., 26) of the sponge 22. The scrim 30 is similarly, substantially disk shaped and preferably has a diameter in the range of approximately 1.0–6.0 in., more preferably, in the range of approximately 2.75–3.25 in. and has a thickness in the range of approximately 0.2–1.0 in.

The scrim 30 is preferably nonwoven, comprising fibers in the range of 0.1–30 denier and includes at least one of the following materials: cellulosic materials, polyethylene, polypropylene, polyester, polyamide and like materials.

As indicated, the scrim 30 includes a cleaning composition having at least one surfactant and, optionally, other components. The surfactant can comprise anionic, nonionic, cationic and/or amphoteric agents either alone or in various combinations. Suitable surfactants include, but are not limited to, sodium lauryl sulfate, sodium xylene sulfonate, coco amine oxide, nonoxynol-9, linear alkyl naphthalene sulfonate, ethoxylated alcohol, alkyl ether sulfates, alcohol ethoxysulfates, alkyl benzene sulfonate, alpha olefin sulfonate, linear alcohol ether sulfates, linear primary alcohol ethoxylate, alkyl sulfates, alkyl aryl sulfonates, amine oxides, taurates, sarcosinates, isethionates, linear alkylbenzene sulfonates, and mixtures thereof.

The cleaning composition can also include one or more bactericidal agents, bleaching agents, chelants, salts, coloring agents and fragrances.

A key component of the disposable cleaning head 20 is the fitment 36. The fitment 36, which is preferably constructed out of polyethylene, polypropylene or a like elastomeric material, is designed and constructed to facilitate rotation and/or bending of the fitment 36 and, hence, head 20 relative to the handle 10. The fitment 36 is further designed and adapted to cooperate with the gripping mechanism of the handle 10 (or tool assembly), whereby when the gripping mechanism is in a gripping condition the fitment 36 is able to withstand axial forces in the range of at least approximately 1.0–30.0 lbs. before the fitment 36 and, hence, cleaning head 20 becomes disengaged from the gripping mechanism and, hence, handle 10.

As set forth in the noted Co-Pending Application Ser. No. 10/663,496, the disposable cleaning head 20 can further comprise (i) the noted scrim 30 and fitment 36, whereby the scrim 30 could similarly include the cleaning composition or (ii) the noted sponge 22 and fitment 36, whereby the sponge 22 could include the cleaning composition.

Figure 4:
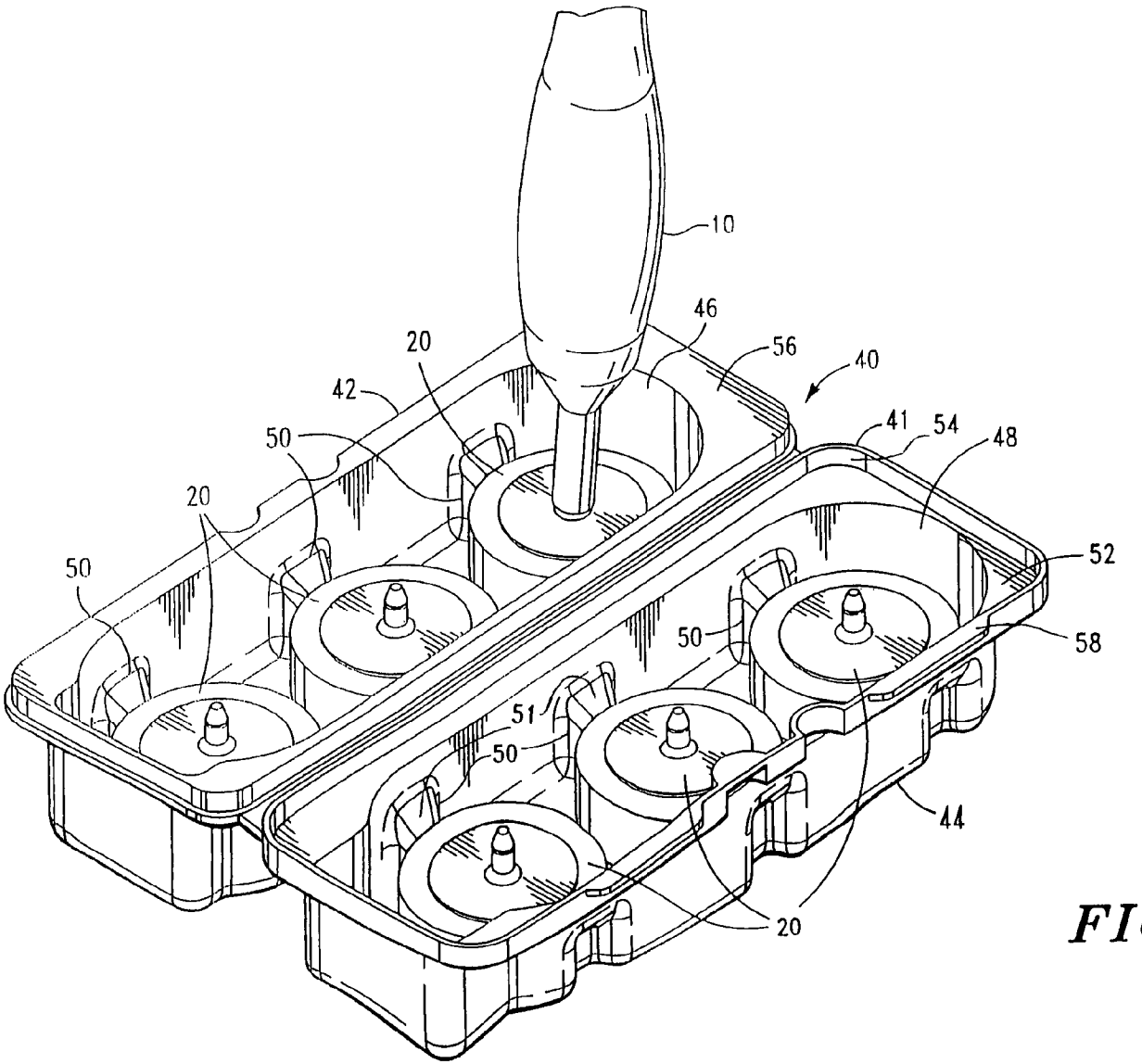
FIG. 4 is a perspective view of one embodiment of the packaging system having a plurality of disposable cleaning heads contained therein, according to the invention.

Referring now to FIGS. 4–8, the packaging system of the invention will now be described in detail. Referring first to FIG. 4, there is shown one embodiment of the packaging system 40. As illustrated in FIG. 4, the packaging system 40 comprises a shell 41 having a bottom 42 and top 44 that is preferably hingedly connected (designated generally 43 in FIG. 6) to the bottom 42.

In a preferred embodiment, the bottom 42 includes a first cavity 46 and the top 44 includes a second cavity 48. The cavities 46, 48 preferably have substantially similar planar dimensions (i.e., length, width) and configurations (see FIG. 5).

As illustrated in FIG. 4, the first and second cavities 46, 48 are configured and adapted to receive at least one, more preferably, a plurality of cleaning heads 20 therein. In the embodiment shown in FIG. 4, each cavity 46, 48 is adapted to receive three (3) cleaning heads 20 therein. Each cavity 46, 48 is further adapted to removably secure the cleaning heads 20 therein such that the exposed (or bottom 34) surfaces of the scrim 30 are oriented on substantially coincident planes. Thus, each cleaning head 20 is readily accessible to engage the tool assembly 10 without the necessity of direct user contact.

The noted orientation and accessibility also facilitates the packaging and use of a variety of cleaning heads 20 having different cleaning substrates 21 and/or cleaning composition (i.e., variety packs).

According to the invention, the cavities 46, 48 can comprise various configurations and dimensions to receive various configurations, sizes and quantities of cleaning heads 20 (e.g., 2, 8, 12, etc.). In one embodiment of the invention, each cavity 46, 48 has a length (designated "L") in the range of approximately 7.5–8.0 in., a width proximate the opening (designated "W") in the range of approximately 2.5–3.0 in. and a minimum depth (designated "D") in the range of approximately 1.25–1.35 in. (see FIGS. 5 and 7) to facilitate receipt of three (3) cleaning heads 20 having a maximum planar dimension or, in this instance, a nominal diameter in the range of 2.75–3.25 in.

Figure 5:
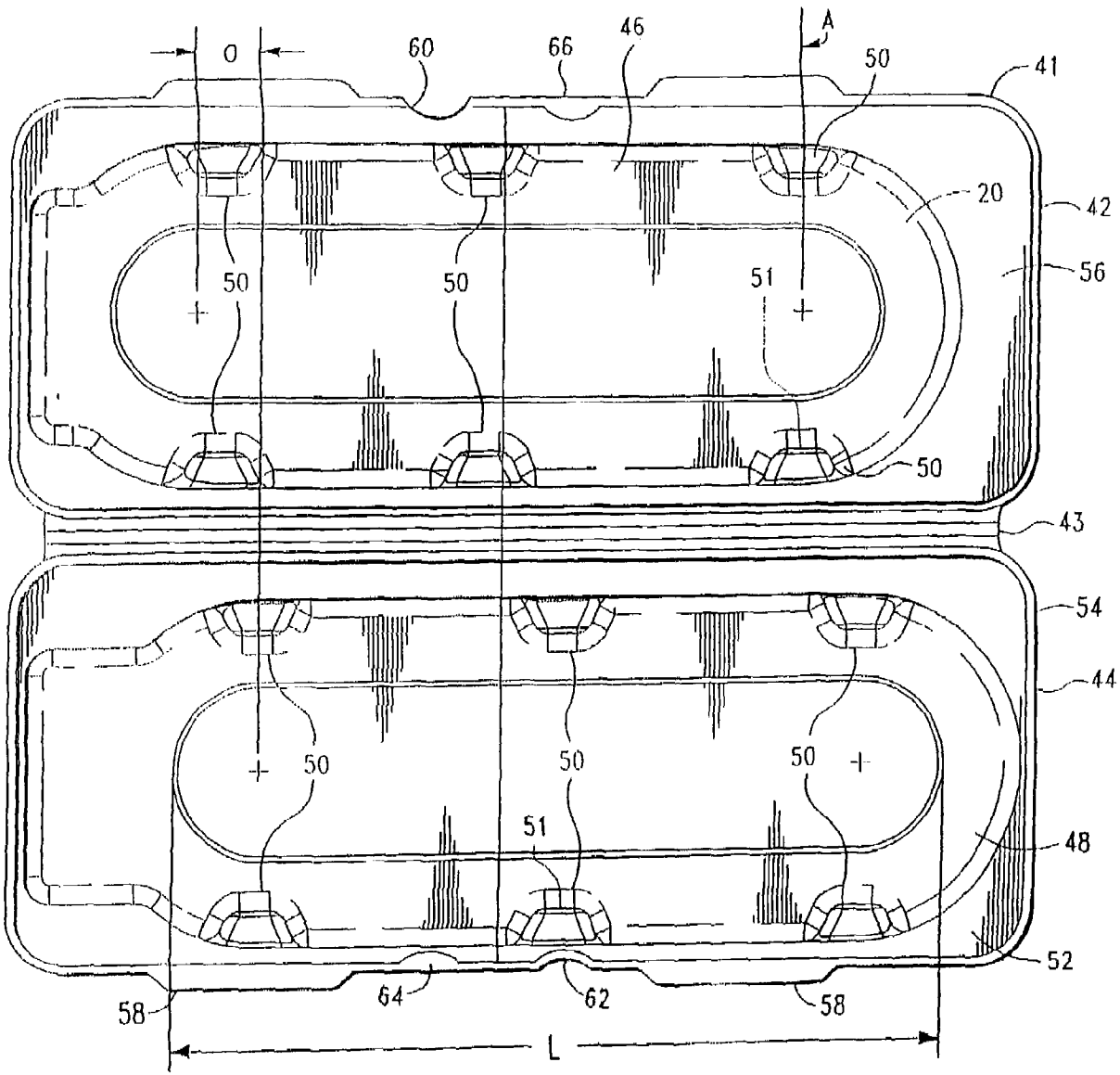
FIG. 5 is a top plane view of the packaging system shown in FIG. 4.
Figure 6:
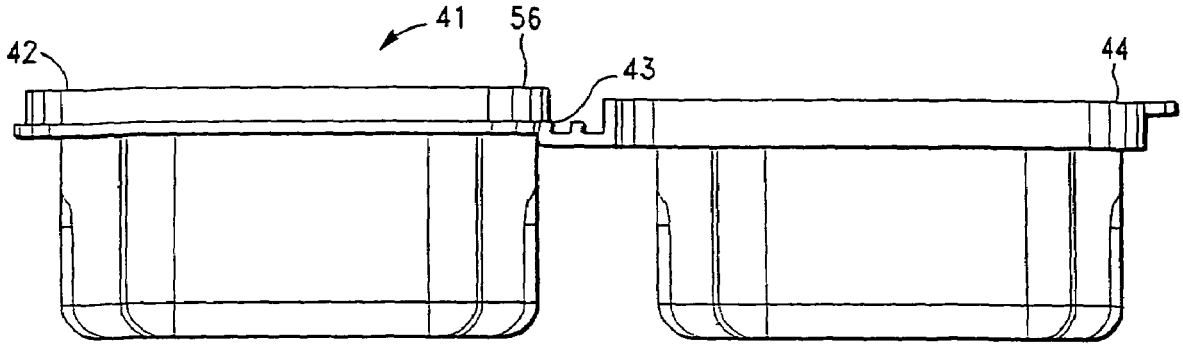
FIG. 6 is a side plane view of the packaging system shown in FIG. 4.

Referring now to FIG. 5, the cavities 46, 48 are preferably disposed in the bottom 42 and top 44 of the shell 41 in an offset orientation to facilitate closure of the shell 41 with cleaning heads 20 disposed therein. As will be appreciated by one having ordinary skill in the art, the amount of the offset (designated "O") will depend on the dimensions of the cleaning head(s) and, hence, each cavity 46,48. Preferably, the offset ("O") is in the range of approximately 25–45% of the maximum planar dimension (e.g., nominal diameter) of the cleaning head(s) 20.

Figure 7:
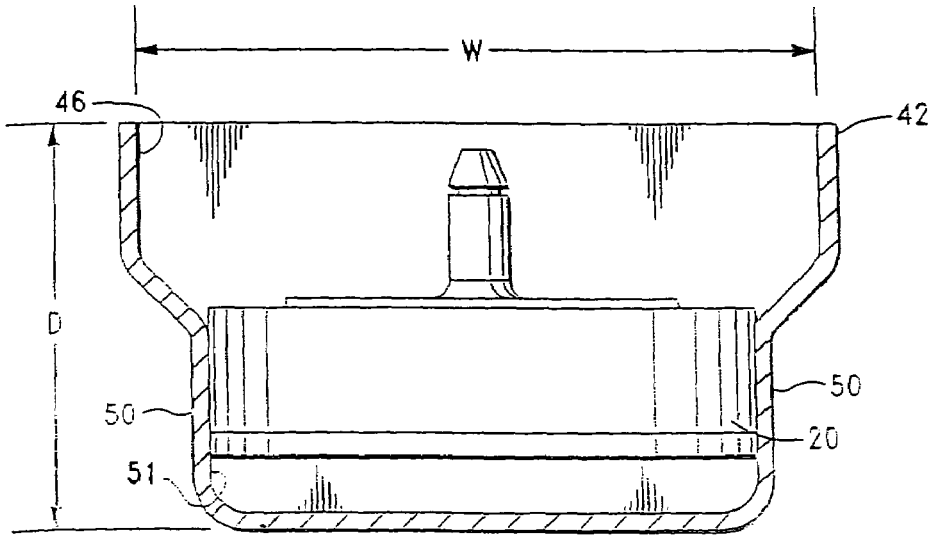
FIG. 7 is a partial section, side plane view of the packaging system, illustrating the interference fit of a disposable cleaning head, according to the invention.

Referring now to FIGS. 4, 5 and 7, each cavity 46, 48 includes a plurality of interference tabs 50 that are positioned and configured to engage and secure the cleaning heads 20 in the cavities. As illustrated in FIG. 5, the tabs 50 are preferably disposed as opposing pairs to engage a respective cleaning head 20 proximate its horizontal axis (designated "A" in FIG. 5). Thus, in the embodiment shown in FIGS. 4 and 5 and described above, each cavity 46, 48 includes three (3) pairs of tabs 50 (or six (6) total tabs 50).

According to the invention, the tabs 50 are configured and dimensioned to effectuate an interference fit or engagement of a respective cleaning head 20 in the range of approximately 0.05–0.50 in., more preferably, in the range of approximately 0.10–0.40 in. Even more preferably, the tabs 50 effectuate an interference fit in the range of approximately 0.10–0.30 in.

In a preferred embodiment of the invention, the face of each tab 50 (designated generally "51") has a textured surface to enhance the engagement and retention of the cleaning head 20 positioned therebetween. As will be appreciated by one having ordinary skill in the art, various conventional molding and post molding processes can be employed to provide a textured surface to the tab faces 51. In one embodiment of the invention, the textured surface is achieved via a sand or other medium blasting operation.

Figure 8:
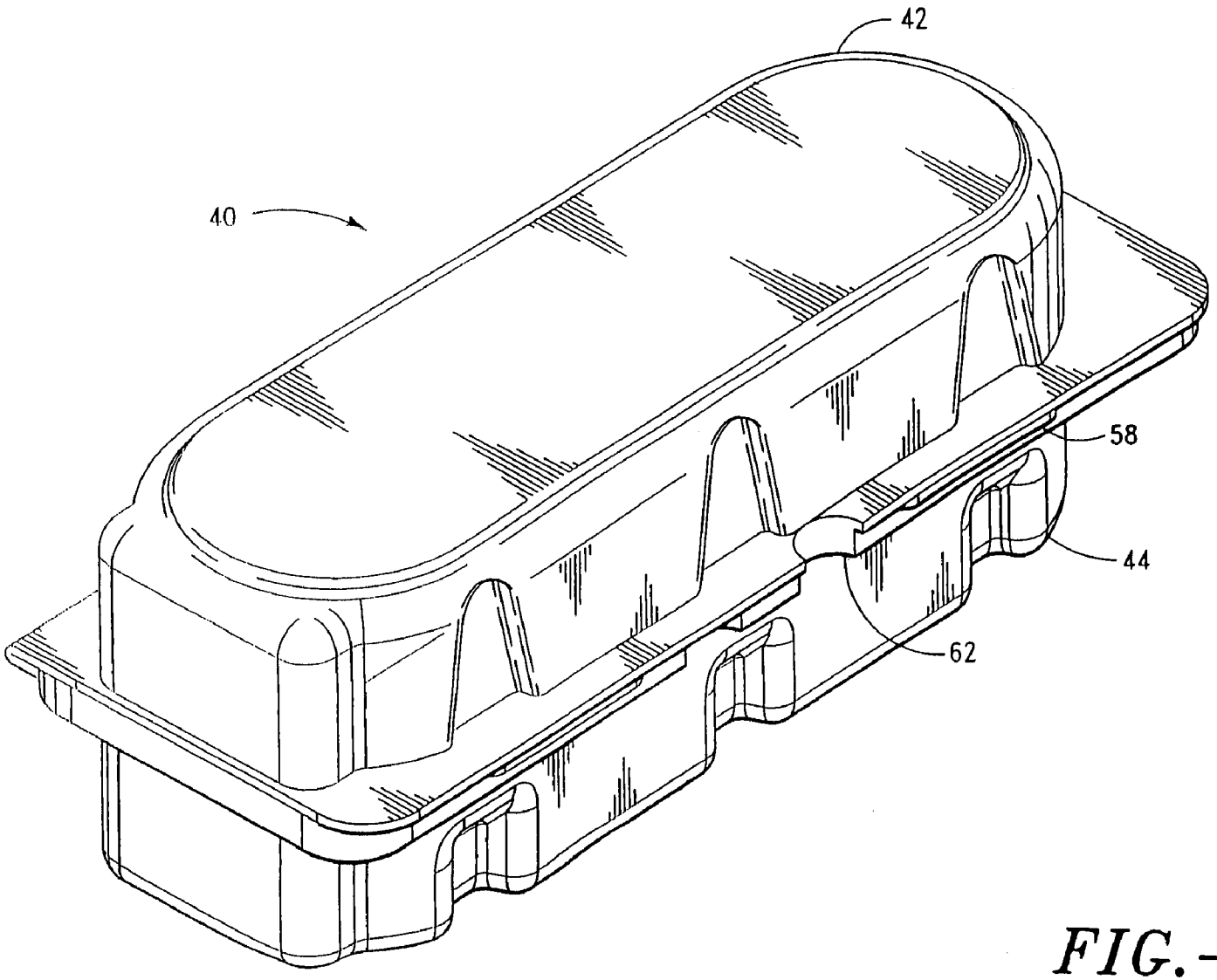
FIG. 8 is a perspective view of the packaging system shown in FIG. 4, in a closed position, according to the invention.

As illustrated in FIGS. 4 and 5, the top 44 includes a seat portion 52, having a peripheral wall 54 that is configured and dimensioned to receive the top, planar portion 56 of the bottom 42 when the shell 41 is in a closed configuration (see FIG. 8). The top 44 further preferably includes a pair of locator tabs 58 that extend from the wall 54 that are designed and adapted to guide the planar portion 56 of the bottom 42 into the seat portion 52 of the top 44 during closure of the shell 41.

Referring now to FIG. 5, to facilitate opening of the shell 41, the bottom 42 and top 44 include opening tabs 60, 62, respectively. According to the invention, the bottom opening tab 60 is configured and positioned to align with the planar tab region 64 on the top 44 when the shell 41 is in a closed position. The top opening tab 62 is similarly configured and positioned to align with the planar tab region 66 on the bottom 42 when the shell 41 is in a closed position. The noted opening tabs 60, 62 thus facilitate easy opening of the shell 41 by a user.

According to the invention, the shell 41 can be constructed out of various light weight materials, such as polyethylene terephthalate, polypropylene, polyethylene, polycarbonate, polyamides, polyvinylchloride and polystyrene. Preferably, the shell 41 is constructed out of polyethylene terephthalate.

The shell 41 can further comprise a single or multi-layer construction that includes a high barrier plastic, such as, but not limited to, polyethylene terephthalate, polyamide, polyvinyl alcohol, poly acrylonitrile, or a like thermoplastic material, and/or a blend or copolymer of the above noted materials, such as PAN/PMMA, available under the trade name Barex®. The multi-layer construction can also comprise a lower cost material, including, but not limited to, a polyolefin, polypropylene, polystyrene, polyvinyl chloride, polycarbonate or post consumer resins, and one or more of the noted barrier materials to lower the overall package cost.

In an additional embodiment of the invention, not shown, the shell 41 includes a paperboard sleeve to enhance shelf stability and optimal label space. In yet a further envisioned embodiment, the shell 41 includes shrink labels or in-mold labeling.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

What is claimed is:

1. A packaging system, comprising:

a plurality of disposable cleaning heads, each of said plurality of cleaning heads having a maximum planar dimension and including at least one cleaning substrate and a one-piece flexible fitment, said fitment including an engagement member adapted to removably engage a handle; and a shell having a bottom and a top, said top being hingedly connected to said bottom whereby said shell has an open position and a closed position, said bottom including a first cavity adapted to receive at least a first disposable cleaning head of said plurality of cleaning heads, said top including a second cavity adapted to receive at least a second disposable cleaning head of said plurality of cleaning heads.

2. The packaging system of claim 1, wherein said receipt of said first disposable cleaning head in said first cavity and said second disposable cleaning head in said second cavity comprises an interference fit.

3. The packaging system of claim 2, wherein said interference fit is in the range of approximately 0.05–0.50 in.

4. The packaging system of claim 3, wherein said interference fit is in the range of approximately 0.10–0.30 in.

5. The packaging system of claim 1, wherein said first cavity includes at least a first pair of interference tabs and said second cavity includes at least a second pair of interference tabs, each of said first and second pairs of interference tabs including an engagement face, said first pair of interference tabs being positioned in said first cavity whereby said first disposable cleaning head is engaged at opposing positions proximate a planar axis of said first disposable cleaning head, said second pair of interference tabs being positioned in said second cavity whereby said second disposable cleaning head is engaged at opposing positions proximate a planar axis of said second disposable cleaning head.

6. The packaging system of claim 5, wherein said engagement faces of said first and second pairs of interference tabs include a textured surface.

7. The packaging system of claim 1, wherein said first and second cavities are disposed in said shell bottom and top in an offset orientation, whereby said packaging system can be placed in said closed position with said first and second disposable cleaning heads disposed therein.

8. The packaging system of claim 7, wherein said offset comprises in the range of approximately 25–45% of said maximum planar dimension of said first and second cleaning heads.

9. The packaging system of claim 1, wherein said first cavity is adapted to receive at least three of said plurality of cleaning heads.

10. The packaging system of claim 1, wherein said second cavity is adapted to receive at least three of said plurality of cleaning heads.

11. The packaging system of claim 1, wherein said shell comprises a material selected from the group consisting of polyethylene terephthalate, polypropylene, polyethylene, polycarbonate, polyamides, polyvinylchloride and polystyrene.

12. The packaging system of claim 1, wherein said cleaning substrate comprises a substrate selected from the group consisting of a sponge and scrim.

13. The packaging system of claim 1, wherein said cleaning substrate comprises a sponge and scrim.

14. A container for a cleaning system, the cleaning system having at least one cleaning head adapted to clean a toilet bowl, comprising:

a plurality of disposable cleaning heads, each of said plurality of cleaning heads having a maximum planar dimension and including at least one cleaning substrate and a one-piece flexible fitment, said fitment including an engagement member adapted to removably engage a handle; and a shell having a bottom and a top, said top being hingedly connected to said bottom whereby said shell has an open position and a closed position, said bottom including a first cavity adapted to receive at least a first disposable cleaning head of said plurality of cleaning heads, said top including a second cavity adapted to receive at least a second disposable cleaning head of said plurality of cleaning heads, wherein said receipt of said first disposable cleaning head in said first cavity and said second disposable cleaning head in said second cavity comprises an interference fit, whereby each of said first and second disposable cleaning heads is readily accessible to engage said handle when said shell is in said open position without the necessity of direct user contact with said first or second disposable cleaning heads.

* * * * *